United States Patent [19]

Steele

[11] 4,444,160

[45] Apr. 24, 1984

[54] ENERGIZATION INDICATION CONTROL FOR DIESEL GLOW PLUG

[75] Inventor: Robert E. Steele, Cortland, Ohio

[73] Assignee: General Motors Corporation, Detroit, Mich.

[21] Appl. No.: 416,212

[22] Filed: Sep. 9, 1982

[51] Int. Cl.[3] ..... F02N 17/00

[52] U.S. Cl. ..... 123/179 H; 123/145 A; 123/179 BG; 219/504; 361/165

[58] Field of Search ..... 123/179 H, 179 BG, 145 A; 219/504, 505, 492; 361/165

[56] References Cited

U.S. PATENT DOCUMENTS

| | | | |
|---|---|---|---|
| 3,600,118 | 8/1971 | Hirsbrunner | 361/165 |
| 4,088,109 | 5/1978 | Woodruff et al. | 123/179 H |
| 4,137,885 | 2/1979 | Van Ostrom | 123/179 H |
| 4,177,785 | 12/1979 | Sundeen | 123/179 H |
| 4,307,688 | 12/1981 | Steele | 123/179 H |
| 4,337,389 | 6/1982 | Bell | 123/179 H |
| 4,357,525 | 11/1982 | Jenne | 219/505 |

FOREIGN PATENT DOCUMENTS

| | | | |
|---|---|---|---|
| 57-81162 | 5/1982 | Japan | 123/145 A |

*Primary Examiner*—Parshotam S. Lall
*Attorney, Agent, or Firm*—Robert M. Sigler

[57] ABSTRACT

An indicating lamp and a PTC thermistor are connected in series across an electric power source by an ignition switch which simultaneously actuates apparatus to intermittently energize a diesel engine glow plug. Further apparatus is effective to make and break a low resistance shunt path around the indicating lamp in response to deenergization and energization of the glow plug. The indicating lamp and PTC thermistor both are electrically energized to self heat and both have electrical resistances increasing sufficiently with temperature to drop substantially most of the supply voltage when hot and prevent energization of the cold other. The indicating lamp heats much faster than the PTC thermistor and so energizes during the initial energization of the glow plug to signal the vehicle operator to not attempt starting of the engine. However, upon the first making of the low resistance shunt path, the PTC thermistor increases its resistance to drop substantially most of the supply voltage and maintains this condition through further cycling to prevent further energization of the indicating lamp.

3 Claims, 9 Drawing Figures

ENERGIZATION INDICATION CONTROL FOR DIESEL GLOW PLUG

BACKGROUND OF THE INVENTION

This invention relates to diesel engines of the type using electrically energized glow plugs for aid in cold engine starting and more particularly of the type including an indicating lamp to signal the initial energization period of the glow plug and thus warn the operator not to attempt starting the engine during such period.

Diesel engines of the type used in motor vehicles are known to require aid in cold starting. This aid is commonly provided in the form of glow plugs which may be electrically energized to heat to a temperature sufficient to help initiate combustion of the fuel and air in the combustion chambers as the engine is cranked by a starting motor. In the case of vehicles with 12 volt electrical systems, a 12 volt rated glow plug may take a considerable length of time to heat to the required temperature, particularly during cold winter weather. Therefore, it has become the practice in at least some engines to provide glow plugs rated for operation at a lower voltage, which glow plugs are energized with the full 12 volts of the electrical system for fast heating. Since such glow plugs typically reach the required temperature in approximately seven seconds or less and may burn out if subjected to energization for significantly longer times, control means are provided for allowing an initial energization period of the required duration and then providing an automatic substantial reduction in current to the glow plug. One type of control system provides full energization for an initial period during which the glow plug heats to the required temperature and then alternately deenergizes and energizes the glow plug in a cyclical manner to maintain the glow plug at the required temperature until the engine is securely started.

It is also customary to provide an indication to the vehicle operator upon initial actuation of the vehicle ignition switch that the engine is not yet ready to start. The typical means of providing such an indication is an indicating lamp on the vehicle dashboard which is energized, upon initial actuation of the ignition switch, concurrently with the glow plugs during their initial energization. Although some control systems energize the indicating lamp concurrently with the glow plugs at all times, this leads, in a system such as that described above wherein the initial glow plug energization period is followed by a cyclical energization, to a cyclical energization of the indicating lamp after the engine is ready to start. Many designers of such systems, however, believe that the indicator lamp should be energized only during the time when the engine is not ready to start and should remain deenergized once the engine becomes ready to start, regardless of the cyclical energization of the glow plugs, so that any further energization of the lamp may be used to signal a fault in the system.

There are some prior art systems which provide for an indicating lamp which is energized only during the initial energization of the glow plugs. A variety of means are provided for accomplishing this goal. One system, for example, provides separate means to energize the glow plugs during the initial and subsequent cyclical energizations, with the initial energization means also causing the energization of the indicator lamp. This accomplishes the purpose, but at the expense of two separate glow plug energization means, which may not be desirable for all systems. Another system, shown in the Sundeen U.S. Pat. No. 4,177,785, provides a self-latching relay actuated at the end of the initial energization of the glow plugs which breaks the indicator lamp circuit to extinguish the lamp and thus maintains the lamp deenergized through subsequent cyclical energizations of the glow plugs. This approach also works, but at the expense of a separate, self-latching relay. A further approach is shown in the Steele U.S. Pat. No. 4,307,688. This system provides a transistor shunt current path around an RC timer during the initial energization of the glow plugs and turns off the transistor to remove the shunt path during the first deenergization of said glow plugs. The capacitor of the RC timer thus charges up to block subsequent current flow through the lamp and activate a comparator latch to prevent further activation of the transistor shunt current path during subsequent cyclical energization of the glow plugs. This approach also works but at the expense of an RC timer, Darlington transistor and comparator latch.

SUMMARY OF THE INVENTION

It is an object of this invention to provide an energization indication control for a glow plug in a diesel engine in which an indicating lamp is energized during initial energization of the glow plug and maintained in a deenergized condition during subsequent cyclical energizations of the glow plug using means which are simpler and less expensive than those previously used in the prior art.

This and other objects are achieved in an energization indication control for a glow plug in a diesel engine comprising an indicating lamp connected in series with a timer of the type having a minimum energization voltage and an electrical resistance which is increased and decreased after a time lag following the beginning of continuous energization and deenergization, respectively. The lamp also has a minimum energization voltage and is effective to quickly increase and decrease its electrical resistance in response to energization and deenergization, respectively. The system further includes an electric current source at a predetermined supply voltage, first means effective when actuated to intermittently energize the glow plug in a predetermined manner, second means responsive to the first means to make and break a low resistance shunt path around the lamp while the glow plug is deenergized and energized, respectively, and third means actuable to simultaneously actuate the first means and connect the lamp and timer across the current source. Upon initial energization of the glow plugs by actuation of the third means, the indicating lamp will light and quickly increase its electrical resistance to enlarge its proportion of the supply voltage and thus reduce the voltage supplied to the timer to a level below its minimum actuation voltage to deenergize the timer before it can increase its own electrical resistance substantially. Upon the first deenergization of the glow plugs, the low resistance shunt path is connected to deenergize the lamp and provide full supply voltage across the timer, which then increases its own electrical resistance after the time lag. Upon subsequent cyclical energizations of the glow plugs with corresponding breakings of the low resistance shunt path, the majority of the supply voltage is dropped across the timer in its high resistance state; and the current flow through the lamp is insufficient to energize it. A timer perfectly suited to such a system is a positive temperature coefficient (PTC) thermistor.

Further details and advantages of this invention will be apparent from the accompanying drawings and following description of a preferred embodiment.

DESCRIPTION OF THE PREFERRED EMBODIMENT

Figure 1:
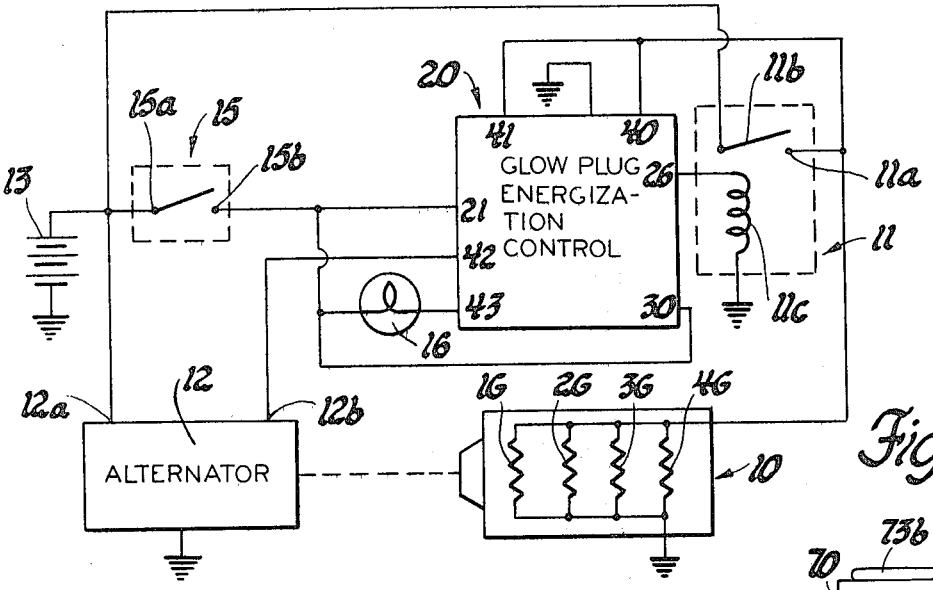
FIG. 1 shows a diesel engine with a glow plug energization control according to this invention.

Referring to FIG. 1, a diesel engine 10 is provided with a plurality of glow plugs 1G, 2G, 3G and 4G, each associated with a respective engine 10 combustion chamber. Although the number of glow plugs is shown as 4, it is understood that there will be one glow plug for each engine combustion chamber and the number of engine combustion chambers may be greater or less than four. The glow plugs 1G–4G are connected electrically in parallel between ground and one contact **11*a* of a relay 11 having an armature 11*b* and actuating coil 11*c***.

A vehicle electrical power supply includes an automotive type alternator 12 of the type shown in the Cheetham et al U.S. Patent No. 3,538,362 or Steele U.S. Pat. No. 4,307,688 and a battery 13. It is understood that alternator 12 is mechanically driven by diesel engine 10 to generate electric power while engine 10 is operating and that the system is a typical automotive electric power supply system including such further items as a voltage regulator, fuses and other devices not shown. Although the voltage regulation is not perfect, the system is understood to act substantially as a source of electric current at a predetermined supply voltage of approximately 12 volts. The supply current from alternator 12 is obtained from a positive polarity output terminal **12*a* of a conventional 6 diode bridge full wave rectifier circuit, as shown in the aforementioned patents. Output terminal 12*a* is connected to the positive terminal of battery 13, to one side 15*a* of an ignition switch 15 and to armature 11*b* of relay 11. Alternator 12 further includes an output terminal 12*b* from the conventional diode trio, not shown, which provides the energizing current for the alternator field winding, not shown. Furthermore, a charge indicator lamp 16 of the type well known in the automotive engine art has one terminal connected to the other terminal 15*b* of the ignition switch 15. The same terminal of charge indicator lamp 16, along with the other terminal thereof, terminal 12*b* of alternator 12, one end of actuating coil 11*c*, the ungrounded ends of glow plugs 1G–4G and terminal 15*b* of ignition switch 15 are all connected to various terminals of a glow plug energization control 20**, which is shown in circuit detail in FIG. 2.

Figure 2:
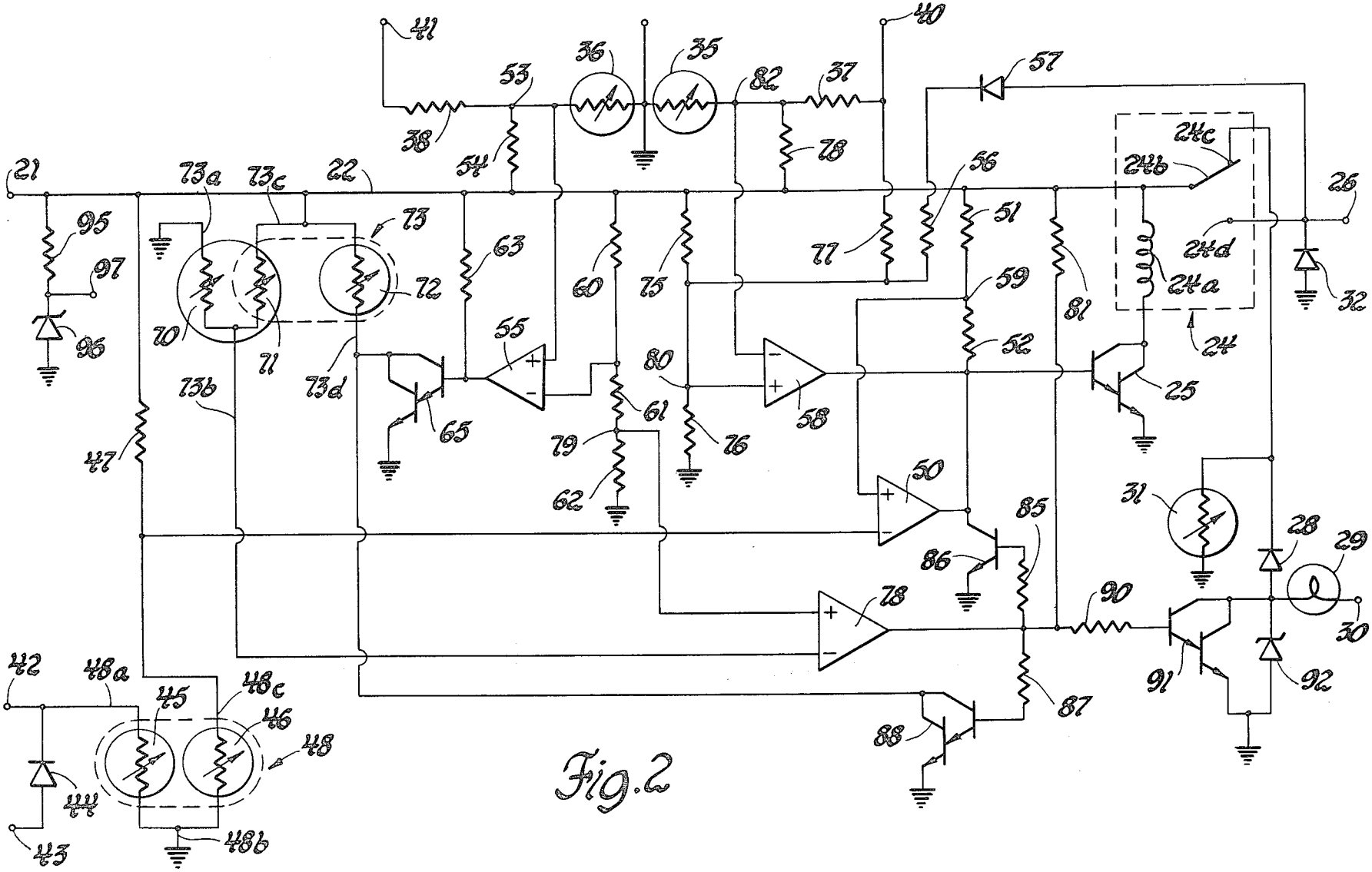
FIG. 2 shows an electrical circuit for use as the glow plug energization control in the system of FIG. 1.

Referring to FIGS. 1 and 2, terminal **15*b* of ignition switch 15 is connected to a terminal 21 of glow plug energization control 20 which, in turn, connects to a positive supply rail 22. Positive supply rail 22 is connected through an actuating coil 24*a* of a relay 24 to the collector of an NPN Darlington transistor 25 having a grounded emitter. Relay 24 further includes an armature 24*b* connected to positive supply rail 22, a normally closed contact 24*c* and a normally open contact 24*d*. Normally open contact 24*d* connects with a terminal 26 of glow plug energization control 20 which is, in turn, connected through actuating coil 11*c* of relay 11 to ground. Normally closed contact 24*c* connects to the cathode of a diode 28 the anode of which is connected through an indicator or "wait" lamp 29 to a terminal 30 of glow plug energization control 20, which terminal 30 is connected to contact 15*b* of ignition switch 15. Normally closed contact 24*c* of relay 24 is further connected through a positive temperature coefficient (PTC) thermistor 31 to ground. A diode 32, the cathode of which is connected to terminal 26 of glow plug energization control 20 and the anode of which is grounded, serves as a free wheeling diode for the actuating coil 11*c* of relay 11. Lamp 29** is a standard 3 candle power, wedge base 14 volt, 360 ma indicating lamp of the kind in standard use within automotive dashboard displays.

Figure 9:
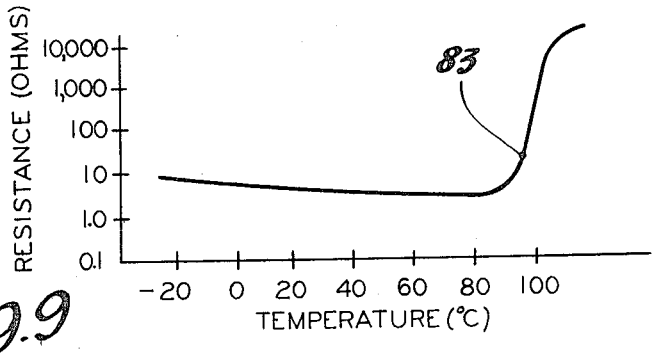
FIG. 9 shows a curve of resistance versus temperature for a typical PTC thermistor.

PTC thermistor 31 is of the type having a resistance versus temperature characteristic curve as shown in FIG. 9. As seen in this curve, the PTC thermistor is characterized by a substantially constant resistance throughout a first temperature range and an abrupt increase in resistance at a switch temperature which marks the upper boundary of the first temperature range with a much higher resistance in a second temperature range above the switch temperature. The resistance in the first temperature range is generally from six to twelve ohms; and the resistance may increase by several orders of magnitude to hundreds or thousands of ohms within a temperature range of a few degrees at the switch temperature. The PTC thermistor may be manufactured with a specified switch temperature and may be, for example, a resistor such as one designated RL3006-50-90-25-PTO, marketed by Keystone Carbon Company, Thermistor Division, St. Mary's, Pa. and having a switch temperature of 90° C. Although such PTC thermistors are sensitive both to ambient temperature and to the heat produced by current flow therethrough, the second effect only is utilized in the application of PTC thermistor 31 in this circuit. PTC thermistor 31 is used as a timer which is also a variable electrical resistor. As an electrical resistor, PTC thermistor or timer 31 will generate heat, when a voltage is supplied thereacross to generate a current therein, at the rate $V^2/R$, where V is the applied voltage and R is the resistance thereof. It will further lose heat to the environment at a rate which, although perhaps not completely independent of the applied voltage, varies far less therewith than the rate of heat generation. For a given set of environmental and design parameters, there is a certain voltage applied to PTC thermistor or timer 31 below which the heat generation rate will be less than or equal to the heat loss from timer 31 so that the temperature thereof does not increase, no matter how long the voltage is applied. On the other hand, if a greater voltage is applied to timer 31, the generated heat will be greater than the heat loss and the temperature will gradually increase at a rate which increases with the applied voltage. As it increases throughout the first or lower range, the resistance of timer 31 will remain substantially constant at approximately six to seven ohms. However, when the temperature reaches the switch temperature, the resistance will increase by a substantial factor in a very short time and stabilize at a higher resistance. Thus PTC thermistor 31 acts as a timer, substantially increasing its resistance after a time duration following the application thereto of a voltage greater than a minimum energization voltage. In addition, when the current is removed from PTC thermistor 31 in its heated, high resistance condition, a time lag will occur as it cools before its resistance decreases to its low value.

Indicator lamp 29 is also a PTC resistance device. It further requires a minimum energization voltage, which is not necessarily the same as that of PTC thermistor 31, to glow in a visible manner. When lamp 29 is unenergized, it produces little heat so that it does not substantially increase in temperature and has a characteristic resistance of approximately four ohms. If the minimum energization voltage is exceeded, however, the lamp will glow and produce sufficient heat to very quickly increase its resistance to approximately 40 ohms. The time lag in the increase of resistance for indicator lamp 29 is approximately one second, substantially less than that of timer 31 for voltages less than 12 volts.

If indicator lamp 29 and timer 31 are connected in series across a source of current at a sufficient supply voltage (such as 12 volts), the lamp will be energized and, within about one second, increase its resistance to 40 ohms compared to about six ohms for the timer 31, so that the majority of the supply voltage is dropped across the lamp. The portion of the supply voltage dropped across timer 31 was only about 60 percent of supply voltage for the first second and then drops to about 13 percent of supply voltage, which is less than the minimum energization voltage thereof so that it does not substantially increase its temperature or its resistance and the lamp remains lit. However, if the timer 31 had been in its high temperature, high resistance state at the time when the current source at the supply voltage was connected across the series combination, timer 31 would have presented a resistance of hundreds of ohms or more compared with the four ohms of the lamp so that the portion of the supply voltage dropped across lamp 29 would not exceed the minimum energization voltage thereof and almost all the supply voltage would be applied to timer 31 to maintain its temperature and resistance; and lamp 29 would remain unenergized.

Referring back to FIG. 2, the operation of these devices within the circuit will now be explained. When ignition switch 15 is closed so that contacts 15*a* and 15*b* are connected, current may flow from the supply battery 13 at a supply voltage of 12 volts through positive supply rail 22 actuating coil 24*a* of relay 24 and through Darlington transistor 25, if it is conducting, to ground. By the operation of the remainder of circuit 2, which will be explained at a later point in the specification, if engine 10 is sufficiently cold that glow plug energization is required, Darlington transistor 25 will be placed in a conducting state when ignition switch 15 is closed. Thus, armature 24*b* will be actuated to connect with normally open contact 24*d* to actuate relay 11 and thus energize glow plugs 1G–4G. At the same time, contact between armature 24*b* and normally closed contact 24*c* will be broken. The closure of ignition switch 15 further provides current flow through indicator lamp 29, diode 28 and PTC thermistor 31 to ground. If both indicator lamp 29 and PTC thermistor 31 are cold, as would ordinarily be the case upon cold start of engine 10, the first of the situations as described above will occur, with indicator lamp 29 lighting to indicate to the driver that the glow plugs are in their initial energization and the engine not ready for start; and PTC thermistor 31 will remain substantially cold and low in resistance.

The signal that the initial energization of glow plugs 1G–4G should end causes Darlington transistor 25 to become nonconducting and allows relay armature 24*b* to return to its normal position in contact with normally closed contact 24*c*. This, of course, causes the deactivation of relay 11 to deenergize glow plugs 1G–4G and further connects the cathode of diode 28 directly to the positive supply rail 22. Thus a shunt current path is provided from battery 13 and alternator 12 by way of ignition switch 15, positive supply rail 22 and relay armature 24*b*, around lamp 29 and diode 28, directly to PTC thermistor 31, which now receives the full supply voltage. Lamp 29 immediately deenergizes and quickly cools to decrease its resistance to four ohms. PTC thermistor 31 is now energized with full supply voltage and, after a time lag, abruptly increases its resistance. When Darlington transistor 25 is once again activated to cause the actuation of relays 24 and 11 and reenergize glow plugs 1G–4G for the first of the cyclical energizations, armature 24*b* breaks contact with normally closed contact 24*c* of relay 24, thus breaking the shunt path around indicator lamp 29. Now, however, the second situation as described above exists. PTC thermistor 31 has a resistance so high, in comparison with the four ohms resistance of lamp 29, that it still retains substantially the entire voltage drop of the supply voltage from battery 13 so that the voltage applied to lamp 29 is less than its minimum energization voltage. Current flows through indicator lamp 29 to maintain PTC thermistor 31 in its high resistance state; however, that current does not cause lamp 29 to glow or to increase its resistance substantially. Thus, throughout the subsequent cyclical energizations of glow plugs 1G–4G, lamp 29 will remain deenergized. Lamp 29 is seen to be what is often called the "wait" lamp, since its purpose is to signal the operator to wait before starting the engine.

If, when ignition switch is initially closed, the engine is sufficiently warm that no energization of glow plugs 1G–4G is necessary, Darlington transistor 25 will not be made conducting upon the closure of ignition switch 15 and armature 24*b* will remain in contact with normally closed contact 24*c* to provide full supply voltage to PTC thermistor 31 and a shunt current path around lamp 29 from the beginning. Thus lamp 29 will not light at all and PTC thermistor 31 will eventually increase its resistance to further assure that lamp 29 does not light. Thus the circuit provides for energization of the indicator lamp only if the glow plugs are actually energized and only for the initial energization thereof.

The glow plug control itself is similar to that shown in the aforementioned Steele U.S. Pat. No. 4,307,688 in many respects. A pair of PTC thermistors 35 and 36 are identical to those similarly numbered PTC thermistors in the aforementioned Steele patent. PTC thermistor 35 is connected between ground and one end of a resistor 37, the other end of which is connected to a terminal 40 of glow plug energization control 20. PTC thermistor 36 has one end grounded and the other connected to a resistor 38, the other end of which is connected to a terminal 41 of glow plug energization control 20. Both terminals 40 and 41 are connected to the common ungrounded ends of glow plugs 1G–4G. Resistors 37 and 38 are current limiting resistors and the connections are such that PTC thermistors 35 and 36 are provided with a voltage at the same time as the glow plugs 1G–4G. PTC thermistors 35 and 36 and resistors 37 and 38 are all included in a package which may be separate from the remainder of glow plug energization control 20, which package is mounted on the engine cooling jacket to be sensitive both to engine temperature and the self-heating effect of current therethrough. The current through resistor 37 and PTC thermistor 35 is such as to cause PTC thermistor 35 to increase its temperature at such a rate that it will abruptly increase in resistance at the point where the glow plugs 1G–4G are sufficiently hot as to require deenergization. Resistor 38 and PTC resistor 36 perform a similar function, but with a higher switch temperature to serve as a backup in case there is a failure of the PTC thermistor 35 or the primary control circuit to be described below.

A voltage comparator 58 has an inverting input connected to the junction 82 of PTC thermistor 35 and resistor 37, a noninverting input connected to a junction 80 between a resistor 75 connected to the positive supply rail 22 and a resistor 76 connected to ground, and an output connected to the base of Darlington transistor 25. Junction 80 is further connected through a resistor 77 to terminal 40 and through a resistor 56 to the cathode of a diode 57, the anode of which is connected to nor mally open contact **24*d* of relay 24; and junction 82 is further connected to the positive supply rail 22 through a resistor 78. Resistor 75, at 14.3 K, and resistor 76, at 1.54 K help determine a reference voltage at the noninverting input of comparator 58 which depends upon the voltage at terminal 40 applied through resistor 77 at one K. When the glow plugs are energized, battery voltage of approximately 12 volts is applied to terminal 40 and the reference voltage at the noninverting input of comparator 58 is approximately 7.5 volts. When battery voltage is removed from glow plugs 1G–4G, however, terminal 40 is essentially grounded through the negligible resistance of the four glow plugs in parallel and the reference voltage at junction 80 is approximately 0.45 volts. The voltage at junction 82, which also depends upon the voltage at terminal 40 as well as the temperature and therefore the resistance of PTC thermistor 35, is compared with the voltage at the junction 80 by voltage comparator 58 in order to control the conducting state of Darlington transistor 25. When ignition switch 15 is initially closed, the reference voltage at junction 80 is initially 0.45 volts, since the relays have not yet had a chance to actuate and terminal 40 is thus essentially grounded. If engine 10 is hot, the voltage divider of resistor 78 and PTC thermistor 35 will generate a voltage at junction 82 greater than 0.45 volts and the output transistor of voltage comparator 58 will be made conducting to ground in order to sink the current from a series pair of 5K resistors 51 and 52 connected between positive supply rail 22 and the base of Darlington transistor 25. The base will thus be held at one diode drop above ground; Darlington transistor 25** will not conduct and the glow plugs will not be energized.

However, for normal cold engine starting, the resistance of PTC thermistor 35 will be approximately 6 ohms and the voltage at junction 82 will be approximately 0.30 volts. The output transistor of comparator 25 will thus turn off; and Darlington transistor 25 will be biased conductive to actuate relays 24 and 11 and cause the energization of glow plugs 1G–4G. With that energization, 12 volts are supplied to terminal 40, which causes the voltage at junction 80 to jump to approximately 7.5 volts and the voltage at junction 82 to jump to approximately 4.0 volts. The glow plugs remain energized and PTC thermistor 35 begins to increase its temperature and, therefore, its resistance. When the voltage at junction 82 exceeds that at junction 80, Darlington transistor 25 is turned off to deenergize the glow plugs and ground terminal 40. The voltage at junction 80 once again drops to 0.45 volts. The voltage on junction 82 also drops, but not as far, and then begins to slowly decrease as PTC thermistor cools. When the voltage on junction 82 once again falls below the voltage on junction 80, both voltages jump upwards once again with a smaller jump for the voltage on junction 82. PTC thermistor 35 heats again; the voltage on junction 82 rises; and the process is repeated indefinitely until Darlington transistor 25 is finally clamped in an off condition by additional circuitry yet to be described.

Figure 6:
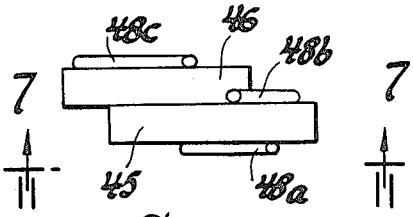
FIGS. 6–8 show top view, side view and equivalent circuit, respectively, of another PTC thermistor device for use in the circuit of FIG. 2.
Figure 8:
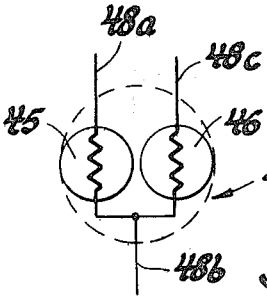
Figure 7:
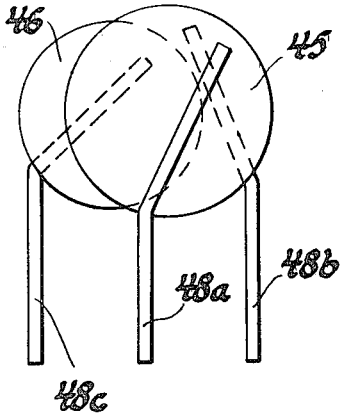

The glow plug energization control further includes a terminal 43 connected to charge indicator lamp 16 and a terminal 42 connected to terminal **12*b* of alternator 12. Terminal 42 is connected to the cathode of a diode 44, the anode of which is connected to terminal 43. Terminal 42 is further connected through a PTC thermistor 45 to ground. Another PTC thermistor 46 forms the lower half of a voltage divider with a resistor 47 between the positive supply rail 22 and ground. PTC thermistors 45 and 46 are physically assembled into an afterglow timer device 48 as shown in FIGS. 6, 7 and 8. As seen in these Figures, afterglow timer 48 comprises a pair of disk-shaped PTC thermistor elements having a substantial portion of one flat face of each joined in a thermally conducting manner. Each of the flat faces is coated with a metallic conductor and leads are attached to the three metallic conductors as shown: lead 48*a* to the outer face of PTC thermistor element 45, lead 48*b* to the common metallic conductor on the inner faces of the PTC thermistor elements 45 and 46 and lead 48*c* on the outer face of PTC thermistor element 46. PTC thermistor 45 is large in thermal mass compared with PTC thermistor element 46 and has a switch temperature of 120° C. as opposed to a 50° C. switch temperature for PTC thermistor element 46**.

Lead **48*c*, which is connected to resistor 47, is further connected to the inverting input of a voltage comparator 50 having a noninverting input connected to the junction 59 of resistors 51 and 52. The output of comparator 50 is further connected to the base of Darlington transistor 25. Since resistors 51 and 52 each have a value of 5 kilohms and the voltage at the output of comparator 58 will be one or two diode drops above ground depending upon its state, the voltage applied to the noninverting input of comparator 50 will be approximately six volts. One of the functions of afterglow timer 48 is to prevent energization of the glow plugs if the engine ambient temperature exceeds 50° C. PTC thermistor element 46, in a voltage divider with one K resistor 47, will have a resistance sufficiently low to provide a small voltage to the inverting input of comparator 50 and thus allow Darlington transistor 25 to be controlled by comparator 58 when the ambient temperature of the engine is less than 50° C. However, if the ambient engine temperature is greater than 50° C. upon the closure of ignition switch 15, the resistance of PTC thermistor 46 will be greater than one K and a voltage higher than six volts will be applied to the inverting input of comparator 50. This will cause the output of comparator 50 to provide a diode path to ground in series with resistors 51 and 52 and thereby clamp Darlington transistor 25** in a nonconducting condition.

The afterglow timer function itself operates in the following manner. Assuming an engine ambient temperature below 50° C., comparator 50 is unactivated at the time of the closure of ignition switch 15. Upon closure of ignition switch 15, current flows from battery 13 to ground through ignition switch 15, charge indicator lamp 16, diode 44 and the parallel combination of PTC thermistor element 45 and circuitry within alternator 12 and the voltage regulator. The voltage drop across PTC thermistor element 45, however, is two volts or less, which is insufficient to cause thermistor 45 to significantly increase in temperature. When the operator starts engine 10, alternator 12 begins generating and a higher voltage appears at terminal 42 to be applied directly across PTC thermistor element 45. Thermistor 45 begins to generate heat sufficient to increase the temperature of the combination of thermistors 45 and 46. When the temperature of the afterglow timer 48 reaches 50° C., the resistance of PTC thermistor 46 increases abruptly to cause voltage comparator 50 to turn off Darlington transistor 25 and hold it off. The delay between the start of engine 10 and the switching of voltage comparator 50 is the afterglow period, which will be seen to vary in an inverse fashion with the initial ambient temperature of engine 10.

However, the heating of afterglow timer 48 does not end at 50° C. but continues until PTC thermistor 45 abruptly increases its resistance at a temperature of 120° C., thus causing PTC thermistor 46 to also reach that temperature. Thus, if engine 10 is shut off, the current through PTC thermistor 45 stops; but it takes some time before the afterglow timer 48 decreases once again to 50° C. During this time, if ignition switch 15 is closed, comparator 50 will continue to hold Darlington transistor 25 in a nonconducting position and no glow plug energization will be allowed. This is the third function of afterglow timer 48.

As mentioned previously, PTC thermistor 36 operates similarly to PTC thermistor 35 but with a higher switch temperature to act as a backup unit therefor. The junction 53 between PTC thermistor 36 and resistor 38 is connected to the positive supply rail 22 through a resistor 54 and is further connected to the noninverting input of a voltage comparator 55 having an inverting input connected through a resistor 60 to positive supply rail 22 and through series resistors 61 and 62 to ground. The output of comparator 55 is further connected through a resistor 63 to positive supply rail 22 and is also connected to the base of an NPN Darlington transistor 65 having a grounded emitter. The voltage divider comprising the resistor 60 over the series resistors 61 and 62 establishes a reference voltage at the inverting input of comparator 55 sufficiently high to turn on the output transistor thereof when the resistance of PTC thermistor 36 is low and thereby hold the base of Darlington transistor 65 below its emitter voltage to maintain it nonconducting. If PTC thermistor 36 reaches its switch temperature, however, and its resistance rises, the voltage applied to the noninverting input of comparator 55 will exceed the reference voltage on the inverting input and the output transistor thereof will be turned off to allow resistor 63 to bias Darlington transistor 65 into a conducting state.

The conduction of Darlington transistor 65 thus indicates an overheat condition and is adapted to deenergize the glow plugs 1G–4G. However, in order to prevent inadvertent deenergization of the glow plugs due to a noise spike or other momentary disturbance in the collector voltage of Darlington transistor 65, a short delay, on the order of 0.25 seconds, is introduced in the deenergization of the glow plugs through a short delay timer comprising PTC thermistor elements 70, 71 and 72 as shown in FIG. 2 and also in FIGS. 3–5.

Figure 3:
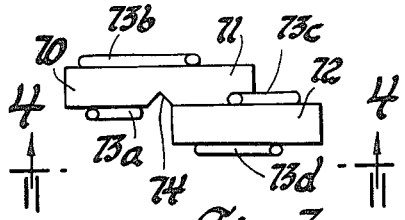
FIGS. 3–5 show top view, side view and equivalent circuit, respectively, of a PTC thermistor device for use in the circuit of FIG. 2.
Figure 4:
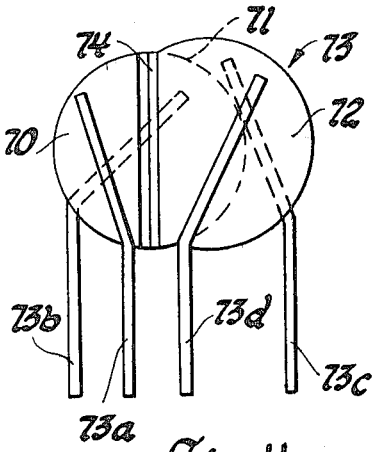
Figure 5:
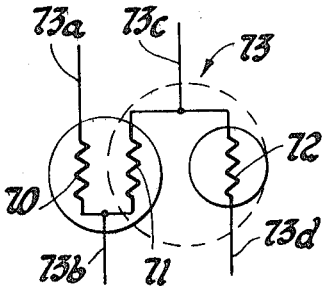

Referring to FIGS. 3 and 4, PTC thermistor elements 70 and 71 are formed from a single disk of PTC thermistor material which is partially divided by a V-shaped groove 74 in such a way as to partially restrict the flow of heat across said groove. The groove marks the boundary between PTC thermistors 70 and 71. Dividing groove 74 also forms a break in a metallic coating on the corresponding flat side of the disk; and there is an unbroken metallic coating on the opposite flat side. PTC thermistor 72 is a similar disk of PTC thermistor material which has a flat side partially joined to the flat side of PTC thermistor 71 and truncated at groove 74. It also has metallic coatings on its opposite flat surfaces. The construction of the short delay timer 73 is such that PTC thermistors 70 and 71 have substantially identical resistance and heat characteristics, however, the flow of heat therebetween past groove 74 is restricted in comparison with the flow of heat through the large junction between the PTC thermistor elements 71 and 72. A plurality of leads are provided: lead **73*a* on the free side of thermistor 70, lead 73*b* on the opposite side of the disk which is the junction of thermistors 70 and 71, lead 73*c* on the junction of resistors 71 and 72 and lead 73*d* on the free side of thermistor 72**.

In the circuit of FIG. 2, lead **73*a* is connected to ground, lead 73*c* is connected to positive supply rail 22, lead 73*d* is connected to the collector of Darlington transistor 65 and lead 73*b* is connected to the inverting input of a voltage comparator 78 having a noninverting input connected to the junction 79 of resistors 61 and 62. Upon closure of ignition switch 15, thermistor 71 and 70 are connected in series across battery 13. Since thermistors 71 and 70 are substantially identical and are not completely thermally isolated, they will have substantially identical resistances which will remain substantially identical as the pair starts to increase in temperature. When the temperature of the pair finally reaches the common switch temperature, the resistances will substantially increase to decrease the heat generation and the device will stabilize at a stabilization temperature with the resistances of thermistor 70 and 71 still being substantially identical. There is no current flow as yet through thermistor 72 and the reference voltage from junction 79 is lower than the substantially one-half supply voltage supplied to the inverting input of comparator 78. The output of comparator 78 is connected to positive supply rail 22 through a resistor 81, which supplies collector current for the output transistor of comparator 78, which is in a conducting state. The output of comparator 78** thus maintains a low voltage, one diode drop above ground.

It will be seen by reference to the curve of FIG. 9 that the thermistors 70 and 71 are being maintained at a point referenced with numeral 83 which is in the lower part of the steep portion of the curve. Thus, if either the thermistors 70 or 71 is heated above this stabilization temperature by an outside source, its resistance will increase very quickly. When Darlington transistor 65 is turned on due to an overheat signal from PTC thermistor 36 through comparator 55, PTC thermistor 72 is immediately connected directly across the battery 13. It immediately begins to generate heat which flows across the large common boundary into thermistor 71 and immediately begins to increase the resistance of thermistor 71 adjacent this boundary. Since the heat must flow a greater distance to get to the boundary between thermistors 70 and 71 and that boundary itself is small and restricted in surface area compared with that between thermistor 71 and 72, the effect is that of the sudden large supply of heat to thermistor 71 which is not immediately supplied to thermistor 70. Thermistor 71 therefore begins increasing in temperature and therefore in resistance at a rapid rate which is to a great degree independent of both ambient temperature outside short duration timer 73 and the supply voltage. The voltage divider formed by thermistor 71 and 70 thus rapidly changes its ratio in the decreasing direction and, after a time delay which is primarily determined by the physical design of the short duration timer 73 itself and not affected much by changes in supply voltage or ambient temperature, causes comparator 78 to switch off its output transistor.

The output of comparator 78 is connected through a resistor 85 to the base of an NPN transistor 86 having a grounded emitter and a collector connected to the base of Darlington transistor 25. It is also connected through a resistor 87 to the base of an NPN Darlington transistor 88 having a grounded emitter and a collector connected to lead **73*d* of short duration timer 73. It is further connected through a resistor 90 to the base of an NPN Darlington transistor 91 having a grounded emitter and a collector connected through lamp 29 to terminal 30 of glow plug energization control 20**.

Therefore, when comparator 78 turns off its output transistor, resistor 81 provides biasing current to turn on transistor 86 which turns off Darlington transistor 25 to deenergize glow plugs 1G–4G, to turn on Darlington transistor 88 which maintains the current flow through thermistor 72 and thus latch off comparator 78, and to turn on Darlington transistor 91 to provide a low resistance shunt current path around PTC thermistor 31 and thus energize lamp 29 as a warning to the vehicle operator that an overheat condition has occurred. An overheat condition thus causes the system to latch into a condition with the glow plugs deenergized and the wait lamp energized as a warning until the ignition switch is once again opened.

Additional circuit elements of interest are resistor 95 supplying electric power from supply rail 22 to the voltage comparators via terminal 97 and protective zener diodes 92 (for transistor 91) and 96 (for the voltage comparators). In addition, diode 57 and resistor 56 provide hysteresis feedback in the glow plug control circuit.

The embodiments of the invention in which an exclusive property or privilege is claimed are defined as follows:

1. An energization indication control for a glow plug in a diesel engine comprising, in combination:

an indicating lamp and a PTC thermistor connectable in series across an electrical power source having a supply voltage sufficient to energize either of the indicating lamp or PTC thermistor separately, said indicating lamp and PTC thermistor being effective to self heat when energized and each having an electrical resistance increasing sufficiently with temperature to drop substantially most of the supply voltage and prevent the energization of the cold other, the resistance increase of the indicating lamp being substantially faster than that of the PTC thermistor;

first means effective, when actuated, to intermittently energize the glow plug to maintain said glow plug in a predetermined temperature condition;

second means responsive to the first means to make and break a low resistance shunt path around said indicating lamp as the glow plug is deenergized and energized, respectively; and third means actuable to simultaneously actuate the first means and connect the indicating lamp and PTC thermistor in series across the electric power source to energize the indicating lamp for the duration of the first period of energization of the glow plug, if any, and if and when the indicating lamp is not energized, to energize the PTC thermistor to increase its resistance and thus prevent further energization of the indicating lamp.

2. An energization indication control for a glow plug in a diesel engine comprising, in combination:

an indicating lamp having an electrical resistance substantially higher when energized than when not energized;

a PTC thermistor having a substantially constant low resistance in a low temperature range and a substantially higher resistance in an adjacent high temperature range, said PTC thermistor being effective when energized to self heat to said high temperature range with a time lag and being connected in electrical series with the indicating lamp;

a source of electric current at a supply voltage effective, (a) when applied across the series combination of indicating lamp and low resistance PTC thermistor to energize the indicating lamp and thereby increase its resistance to drop a percentage of the supply voltage sufficient to prevent energization of the PTC thermistor, (b) when applied across the PTC thermistor alone to energize the same and (c) when applied across the series combination of indicating lamp and higher resistance PTC thermistor to maintain the PTC thermistor at the higher resistance to drop a percentage of the supply voltage sufficient to prevent energization of the indicating lamp;

first means effective, when actuated, to intermittently energize said glow plug as required to maintain said glow plug in a predetermined temperature condition;

second means responsive resistance the first means to make and break a low bubble control shunt path around said indicating lamp while the glow plug is deenergized and energized, respectively; and third means to simultaneously actuate the first means and connect the source of electric current with the supply voltage applied across the series combination of indicating lamp and PTC thermistor, whereby the indicating lamp is energized only for the duration of the initial energization of the glow plug, if such occurs, and otherwise maintained deenergized.

3. An energization indication control for a glow plug in a diesel engine comprising, in combination:

an indicating lamp having a minimum energization voltage, said lamp being effective to quickly increase and decrease its electrical resistance in response to energization and deenergization, respectively;

a timer having a minimum energization voltage and an electrical resistance, said timer being effective to increase and decrease its electrical resistance after time lags following the beginning of continuous energization and deenergization, respectively;

a source of electric current at a supply voltage greater than either of said minimum energization voltages;

first means effective, when actuated, to intermittently energize said glow plug as required to maintain said glow plug in a predetermined temperature condition;

second means responsive to the first means to make and break a low resistance shunt path around said lamp while the glow plug is deenergized and energized, respectively; and third means actuable to simultaneously actuate the first means and connect the lamp and timer in electrical series across the current source, said lamp being energized upon said connection if the shunt path is broken and further being effective following said energization to decrease the proportion of supply voltage to the timer below its minimum energization voltage and thus prevent an increase in the resistance of said timer until the shunt path is first made, after which the timer increases its resistance and is thus effective to prevent subsequent application to the lamp of a voltage greater than its minimum energization voltage to prevent further energization of the lamp, whereby the lamp is energized, if at all, only during initial energization of the glow plug.

* * * * *